US008522981B2

(12) United States Patent
Ballman

(10) Patent No.: US 8,522,981 B2
(45) Date of Patent: Sep. 3, 2013

(54) SCREENING MACHINE AND ASSOCIATED SCREEN PANEL

(75) Inventor: Brady P. Ballman, Loveland, OH (US)

(73) Assignee: Rotex Global, LLC, Cincinnati, OH (US)

( * ) Notice: Subject to any disclaimer, the term of this patent is extended or adjusted under 35 U.S.C. 154(b) by 98 days.

(21) Appl. No.: 13/224,380

(22) Filed: Sep. 2, 2011

(65) Prior Publication Data

US 2011/0314652 A1 Dec. 29, 2011

Related U.S. Application Data

(62) Division of application No. 11/295,259, filed on Dec. 6, 2005, now abandoned.

(51) Int. Cl.
*B07B 1/46* (2006.01)

(52) U.S. Cl.
USPC ..... 209/405; 209/382

(58) Field of Classification Search
USPC ..... 209/381, 382, 405, 408, 409
See application file for complete search history.

(56) References Cited

U.S. PATENT DOCUMENTS

| | | | | |
|---|---|---|---|---|
| 1,932,920 | A | 10/1933 | Berghoefer | |
| 2,114,406 | A | 4/1938 | Simpson | |
| 2,213,773 | A | 9/1940 | Symons | |
| 2,723,032 | A | 11/1955 | Gisler et al. | |
| 2,867,324 | A | 1/1959 | Hirs | |
| 3,022,893 | A * | 2/1962 | Hasley | 209/405 |
| 3,081,874 | A | 3/1963 | Corbin et al. | |
| 3,176,843 | A * | 4/1965 | Hoskins et al. | 209/403 |
| 3,406,823 | A | 10/1968 | Crain | |
| 3,565,251 | A * | 2/1971 | Pennington | 209/323 |
| 4,040,951 | A * | 8/1977 | Cole | 209/408 |
| 4,224,146 | A | 9/1980 | Kent et al. | |
| 4,303,509 | A | 12/1981 | Lilie | |
| 4,498,981 | A * | 2/1985 | Frevert | 209/243 |
| 4,526,682 | A * | 7/1985 | Wallace | 209/337 |
| 4,582,597 | A * | 4/1986 | Huber | 209/313 |

(Continued)

FOREIGN PATENT DOCUMENTS

GB 2322590 A 9/1998

OTHER PUBLICATIONS

S. Howes, Inc., Snappy Shaker, Brochure, 2008, 2 pgs.

(Continued)

*Primary Examiner* — Joseph C Rodriguez
(74) *Attorney, Agent, or Firm* — Wood, Herron & Evans, LLP

(57) ABSTRACT

A screening machine of the type used to separate or classify mixtures of solid particles of different sizes includes a fixed base and a perforate screen mounted for movement relative to the base during a screening operation. The screens are pre-tensioned and mounted in a perimeter frame for separating various granular and particulate material. The frame is slid into the side of the machine in a direction parallel with two opposing bevel lips at the ends of the frame which mate in the screening machine with a complementary channel such that when the screen is raised into sealing contact in the screening machine, the bevel ends of the screen panel frame align the screen panel in the machine. The bevels on the screen panel frame provide a positive sealing surface for contact with the adjacent portions of the channel to prevent product from escaping off of the screen during use.

23 Claims, 3 Drawing Sheets

(56) References Cited

U.S. PATENT DOCUMENTS

| | | | | |
|---|---|---|---|---|
| 4,728,422 | A | 3/1988 | Bailey | |
| 4,820,407 | A | 4/1989 | Lilie | |
| 4,846,352 | A * | 7/1989 | Bailey | 209/399 |
| 5,385,669 | A | 1/1995 | Leone, Sr. | |
| 5,417,589 | A | 5/1995 | Terada | |
| 5,417,859 | A | 5/1995 | Bakula | |
| 5,456,365 | A | 10/1995 | Janssens et al. | |
| 5,614,094 | A | 3/1997 | Deister et al. | |
| 5,615,776 | A | 4/1997 | Bjorklund et al. | |
| 5,636,749 | A | 6/1997 | Wojciechowski | |
| 5,735,409 | A | 4/1998 | Malmberg | |
| 5,851,393 | A | 12/1998 | Carr et al. | |
| 5,967,336 | A | 10/1999 | Baltzer et al. | |
| 6,006,923 | A | 12/1999 | Helmy et al. | |
| 6,053,329 | A | 4/2000 | Ballman | |
| 6,070,736 | A | 6/2000 | Ballman et al. | |
| 6,202,856 | B1 | 3/2001 | Carr | |
| 6,269,954 | B1 | 8/2001 | Baltzer | |
| 6,431,368 | B1 | 8/2002 | Carr | |
| 6,443,310 | B1 | 9/2002 | Schulte, Jr. et al. | |
| 6,484,885 | B1 | 11/2002 | Lilie et al. | |
| 6,672,460 | B2 | 1/2004 | Baltzer et al. | |
| 6,708,829 | B2 | 3/2004 | Robertson et al. | |
| 6,901,870 | B2 | 6/2005 | Eklof et al. | |
| 6,955,262 | B2 | 10/2005 | Seyffert et al. | |
| 7,063,214 | B2 | 6/2006 | Schulte, Jr. et al. | |
| 7,175,027 | B2 | 2/2007 | Strong et al. | |
| 7,216,768 | B2 | 5/2007 | Fisher et al. | |
| 7,478,728 | B2 | 1/2009 | Fisher et al. | |
| 7,516,851 | B2 | 4/2009 | DeCenso et al. | |
| 7,637,378 | B2 | 12/2009 | Malmberg | |
| 7,921,786 | B2 * | 4/2011 | Sund et al. | 110/278 |
| 8,113,358 | B2 | 2/2012 | Smith | |
| 8,261,915 | B2 * | 9/2012 | Bailey et al. | 209/405 |
| 2003/0066786 | A1 | 4/2003 | Seyffert et al. | |
| 2004/0007508 | A1 | 1/2004 | Schulte et al. | |
| 2004/0238434 | A1 | 12/2004 | Fisher et al. | |
| 2005/0056571 | A1 | 3/2005 | Colgrove et al. | |
| 2007/0074998 | A1 | 4/2007 | Langner | |
| 2007/0125688 | A1 | 6/2007 | Ballman et al. | |
| 2008/0245707 | A1 | 10/2008 | Smith | |
| 2009/0308795 | A1 | 12/2009 | Smith | |
| 2010/0018910 | A1 | 1/2010 | Ballman | |
| 2011/0314652 | A1 | 12/2011 | Ballman | |

OTHER PUBLICATIONS

The United States Patent and Trademark Office; Office Action for U.S. Appl. No. 11/295,259; Nov. 17, 2010, 9 pgs.

The United States Patent and Trademark Office; Office Action for U.S. Appl. No. 11/295,259; Apr. 28, 2011, 9 pgs.

International Search Report and Written Opinion issued in counterpart PCT Application No: PCT/US06/43735, mailed Jun. 30, 2008 (8 pages).

* cited by examiner

SCREENING MACHINE AND ASSOCIATED SCREEN PANEL

This is a divisional application of U.S. patent application Ser. No. 11/295,259, filed Dec. 6, 2005 and hereby incorporated by reference in its entirety.

BACKGROUND OF THE INVENTION

This invention relates to screening machines of the type used to separate or classify mixtures of solid particles of different sizes. The invention also relates to screening machines of the type used for liquid/solid separations, i.e., for separating solid particles of specific sizes from a liquid in which they are carried. More particularly, the invention relates to an improved screen panel for use within the screening machine.

In screening machines of the type described, a screen (which may be woven, an aperture plate or another design) is mounted in what is often called a "screen frame" or "screen deck" which includes a supporting peripheral frame around the perimeter of the screen. Some screens are tensioned when they are installed in the screening machine and other screens are pre-tensioned in a frame prior to being installed in the machine. Typically associated with the screen deck are other material handling elements which are moved with the screen and form walls or partitions above or below the screen for containing the liquid and/or particulate materials adjacent to the screen and directing them to appropriate outlets. These elements may comprise a top cover and a pan beneath the screen deck. In the case of screening machines with multiple screens or deck units, spacer pans or frames are provided between the multiple screens.

The screens are often removed from the screening machines for cleaning, replacement, readjustment or installation of a screen of a different mesh size or the like. The screen is releasably mounted to a carrier, table or box to which vibratory motion is imparted, typically by one or more eccentric motors or other means of excitation. The carrier, table or box is referred to herein as a "vibratory carrier". The vibratory carrier may be moved in oscillatory, vibratory, gyratory, gyratory reciprocating, fully gyratory, rotary or another type of motion or combinations thereof, all of which are herein collectively referred to as "vibratory" motion or variations of that term.

In large commercial screening machines, the weight of the various components including the screen assembly carried by the vibratory carrier, and the weight of the material being processed on the screen assembly may total several hundred pounds or more. Screening machines which tension the screen, as opposed to those utilizing pre-tensioned screens, include the added weight associated with the screen tensioning mechanism and related components. This presents a very substantial inertial mass which resists the changes of motion applied thereto by the vibratory drive acting through the vibratory carrier. As a result of these inertial forces, a relative motion may exist between the vibratory carrier and the screen assembly. Typically, the screen assembly and vibratory carrier are each constructed of metal which could result in significant noise, wear and damage due to the relative motion or rubbing action there between. The resulting impact forces between the screen assembly and vibratory carrier significantly increase the stresses on the components and reduce their useful life.

Reducing the metal-to-metal contact minimizes the wear on the various metal components and the noise associated with the operation of the screening machine. Currently, certain screen assembly designs may not be sealed or secured relative to the remainder of the screening machine, particularly in larger screening machines. This results in the above-described metal-to-metal contact between the screen assembly and the remainder of the screening machine and prevents the screening of very fine material, such as sand or the like. The screens in larger screening machines are typically inserted and/or removed from the machine in a generally horizontal, longitudinal direction typically through an opening or slot at the head or foot end of the machine. This method of installation and removal of the screen is detrimental to known sealing arrangements because a seal which would engage the screen assembly could be torn or damaged during the installation/removal of the screen. In other screening machines, the screen is inserted vertically, typically from the top of the machine. Access to the screens from the top of the machine or the longitudinal ends is often very inconvenient and difficult.

SUMMARY OF THE INVENTION

The above-described and other problems with prior art screening machines and associated screen panels have been resolved by this invention. Screening machines according to one embodiment of this invention utilize one or more pre-tensioned screens mounted in a perimeter frame for separating various granular and particulate material. One aspect of this invention is the profile or contour of opposite ends of the perimeter frame for the screen. The mesh screen is mounted to a rigid perimeter frame. The screen is pre-tensioned in the frame as opposed to screens which are stretched or tensioned during the screening machine set up. The frame is slid into the side of the machine in a direction parallel with two opposing contoured profile ends of the frame. In one embodiment, the profile of the frame along each end includes a downwardly directed bevel relative to the plane of the screen. The profile or contour of these ends align with and mate in the screening machine with a complementary channel such that when the screen is raised into sealing contact in the screening machine, the bevel ends of the screen panel frame align the screen panel in the machine through a comparably dimensioned and configured channel on the screening machine. Likewise, the bevels on the screen panel frame provide a positive sealing surface for contact with the adjacent portions of the channel to prevent product from escaping off of the screen during use.

Therefore, according to this invention, the screening operation is much more efficient and more easily accomplished while offering significant advantages in screen service life, installation and removal.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
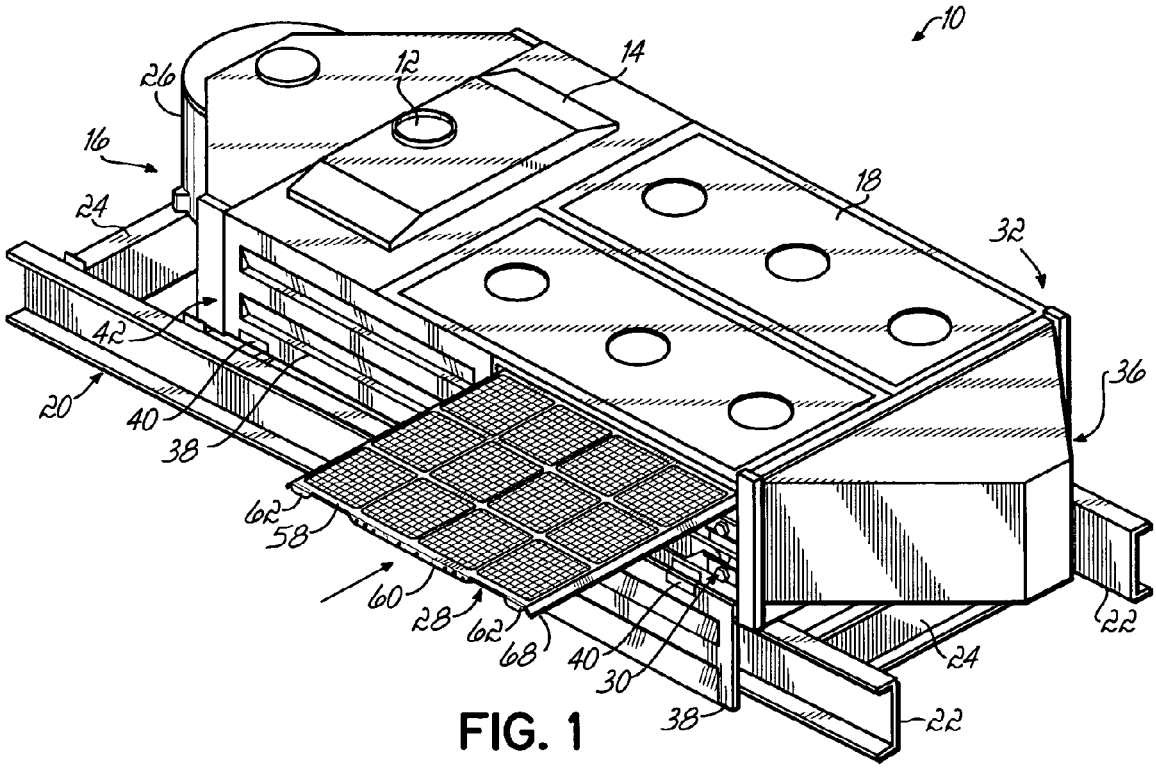
FIG. 1 is a perspective view of an exemplary screening machine and associated screen panel being installed therein according to one embodiment of this invention.

Referring to FIG. 1, an exemplary embodiment of a screening machine 10 in which this invention may be used is shown. Screening machines of many types are sold commercially by Rotex, Inc. of Cincinnati, Ohio, the assignee of this invention. However, this invention is not limited to any particular type of screening machine design or application and the machine shown and disclosed herein is shown for illustrative purposes.

The screening machine 10 includes an inlet port 12 near an inlet section 14 proximate a head end 16 of the machine 10. The screening machine 10 may also include a top cover 18 in any one of a variety of forms. Particulate or other material to be screened is fed into the inlet port 12 from a hopper (not shown) for screening and processing by the machine 10.

The screening machine 10 is supported structurally by a base frame 20 including beams 22 connected together by laterally oriented struts 24 on each end of the screening machine 10. The screening machine 10 includes an electric motor 26 coupled to a drive weight (not shown) to impart an oscillatory, vibratory, gyratory, gyratory reciprocating, fully gyratory, other motion or combinations thereof (herein collectively referred to as "vibratory" motion or variations of that term) to at least the head end 16.

Within a screening chamber of the screening machine 10, one or more screen panels 28 are each mounted in combination to form one or more screen decks 30 to receive the material being screened from the feed chute 12 at the head end 16 of the machine 10. The screen panels 28, are mounted on slightly sloping planes (approximately 4°) with the head end thereof being slightly elevated relative to a foot end so that during the screening process the material advances, in part by gravity, over the screen panels 28 toward the foot or discharge end 32 of the machine 10. Even though the screen panels 28 of the screening machine 10 may be on a slightly sloping plane, to provide a reference for the purposes of clarity herein, these components will be considered to be generally horizontal and the direction perpendicular or orthogonal to the screen panels 28 will generally be referred to as a vertical orientation, direction or attitude. The direction of travel of the material being screened from the head end to the foot end across the screen panels 28 is referred to as the longitudinal direction and the perpendicular orientation extending from side to side on the screen panels is a lateral direction.

In the embodiment of the screening machine 10 shown in FIG. 1, upper and lower screen decks 30 each include four screen panels 28 mounted generally coplanar with each other in the associated screen deck 30. Accordingly, as the material to be screened is deposited from the inlet port 12 onto the upper screen deck 30, the vibratory motion of the screening machine 10 advances the material longitudinally across the top of the screen panels 28 of the upper screen deck 30 toward the foot end 32. Appropriately sized and configured material passes through the upper screen deck 30 and falls onto the lower screen deck 30. The screen panels 28 of the upper screen deck may include a fine mesh screen material 34 adjacent the inlet port 12 through which dust and other fine particulate matter passes for collection and discharge. Certain material also passes through the upper screen deck 30 and is deposited on the lower screen deck 30. Therefore, the lower screen deck 30 is included to provide an additional separating mechanism for the appropriately sized particles to pass through the second lower screen deck 30 for collection in the lower pan (not shown) and discharge through an outlet or exit section 36.

The unacceptably sized particles remain atop the first upper screen deck 30 and fall off the terminal edge thereof into a collection basin for discharge through the outlet section 36. Material that passes through the upper screen deck 30 and remains atop the lower screen deck 30 falls off the terminal edge thereof and into the collection basin for discharge through a reject port (not shown). The discharge and reject ports are separated by a baffle (not shown) to keep the classified particles separate from one another.

Referring to FIG. 1, one or more doors 38 are each pivotally connected by a hinge 40 to a lateral side 42 of the screening machine 10. When opened, the doors 38 provide access for insertion and removal in the lateral direction of the screen panels 28. It will be appreciated that although one side 42 of the screening machine 10 is shown in FIG. 1, additional doors on the opposite side of the screening machine 10 may also be provided. Advantageously, the screen panels 28 are inserted laterally or perpendicularly to the longitudinal direction of travel of the material being screened in the screening machine 10 from the head end 16 to the foot end 32 of the machine 10.

Figure 5A:
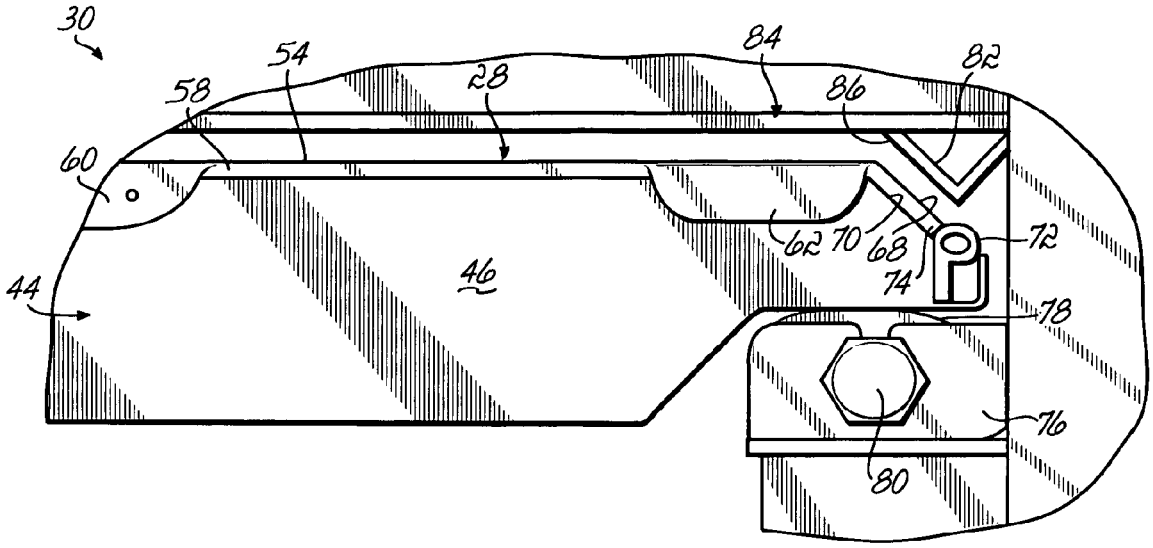
FIG. 5A is a side elevational view of a portion of the screening machine of FIG. 1 and a screen panel inserted therein prior to a screening operation.

As shown generally in FIG. 5A, when the screen panel 28 is inserted into the screening machine 10, it is supported on a vibratory carrier 44. In one embodiment, the vibratory carrier 44 may include a ball tray 46 capturing a number of balls or other agitation producing members (not shown) which repeatedly impact the screen panel 28 to dislodge particulate material that might accumulate on the screen material 34 and inhibit occlusion of the screen material 34 as is well known in the art.

Figure 2:
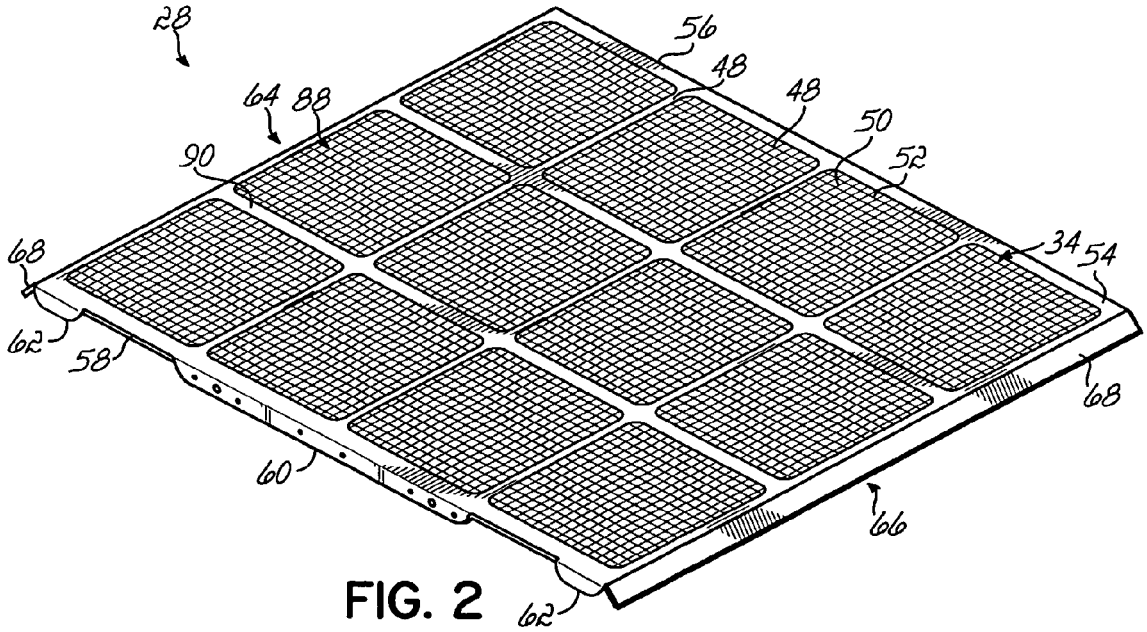
FIG. 2 is a perspective view of the screen panel of FIG. 1.
Figure 3:
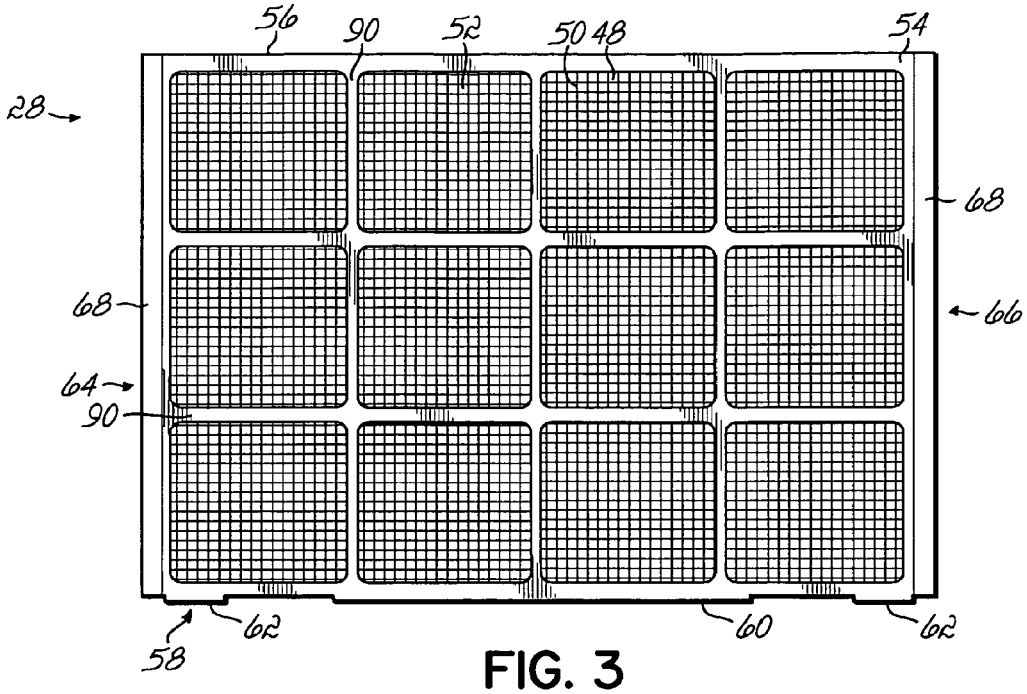
FIG. 3 is a top plan view of the screen panel of FIG. 2.
Figure 4:
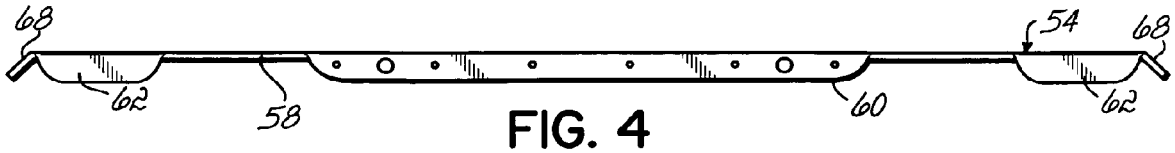
FIG. 4 is a side elevational view of the screen panel of FIG. 2.

Referring to FIGS. 2-4, one embodiment of the screen panel 28 according to this invention includes a generally perforated mesh screen material 34 including a number of intersecting longitudinal 48 and lateral 50 threads, wires or strings which are oriented orthogonally to each other to provide appropriately sized and configured openings 52 in the mesh screen material 34 to prevent/permit the passage particulate material there through. The screen panel 28 includes a generally rigid perimeter frame 54 having a leading side edge 56 opposite from a trailing side edge 58. In one aspect, the screen material 34 of the screen panel 28 of this invention does not require tensioning by the screening machine 10 upon installation into the screen deck 30. Many prior screening machines tension the screen mesh material or pull it taught during the installation process. The screen mesh material 34 of the screen panel 28 according to this invention does not require tensioning and in that sense is considered pre-tensioned in that it is mounted in the screen panel frame 54 in a ready-to-use state.

The panel 28 may be manufactured by a variety of processes, one of which utilizes a bare metal frame which is dipped into an epoxy and allowed to air dry. The epoxy is hard to the touch but has not cured. The frame 54 with dry epoxy is then placed on a table with mesh screen material 34 on top. This stack-up is then bonded together with a heat press for a few minutes. The edges are then cleaned up with a hand grinder, if necessary.

A further benefit of this aspect of the invention is that the process leaves the panel 28 feeling tensioned although no time or fixture is required to pull (tension) the screen material 34 prior to bonding it to the frame 54 or when installing the screen frame panel into the screening machine 10. The new panel 28 design incorporates this approach such that open area is maximized but the tension level is comparable to known tension techniques, such as spring clips.

The leading side edge 56 of the screen panel frame 54 is typically inserted laterally into the screening machine 10 while a user or operator grasps the trailing side edge 58 for manipulation. In particular, a downwardly turned elongate handle 60 is formed on the trailing side edge 58 of the screen panel 28. In one embodiment, the handle 60 is oriented approximately 90° relative to the plane of the screen panel 28 and provides a convenient and easy access for the user or technician to grasp or manipulate the screen panel 28. Additionally, the handle 60 or adjacent surfaces of the screen panel frame 54 provide a convenient location for identifying indicia and labels indicating various service parameters, design characteristics and other aspects of the screen panel 28.

One or more tabs 62 each located proximate a head end 64 or a tail end 66 of the screen frame 54 are located along the trailing side edge 58 of the frame. The tabs 62 are each oriented approximately 90° relative to the plane of the screen panel 28 and along with the handle 60 provide a convenient location for the user or technician to grasp and manipulate the screen panel frame. Likewise, upon insertion of the screen panel 28 into the screening machine 10, the tabs 62 and handle 60 provide a detent when juxtaposed against the vibratory carrier 44 for proper orientation and location of the screen panel 28 in the screening machine 10.

Another aspect of the screen panel 28 and associated frame 54 according to this invention are beveled edges or lips 68 along the longitudinal head end 64 and/or foot end 66 of the screen panel frame 54. Each bevel 68 is oriented approximately 45° relative to the upper surface or plane of the screen panel 28 and extends substantially the entire width of the frame 54. While the bevel 68 are shown along both the longitudinal head and foot ends 64, 66 of the screen panel frame 54, one of ordinary skill in the art will readily appreciate that the bevel edge 68 may be provided at either or both of the head and foot ends 64, 66 within the scope of this invention.

Figure 5B:
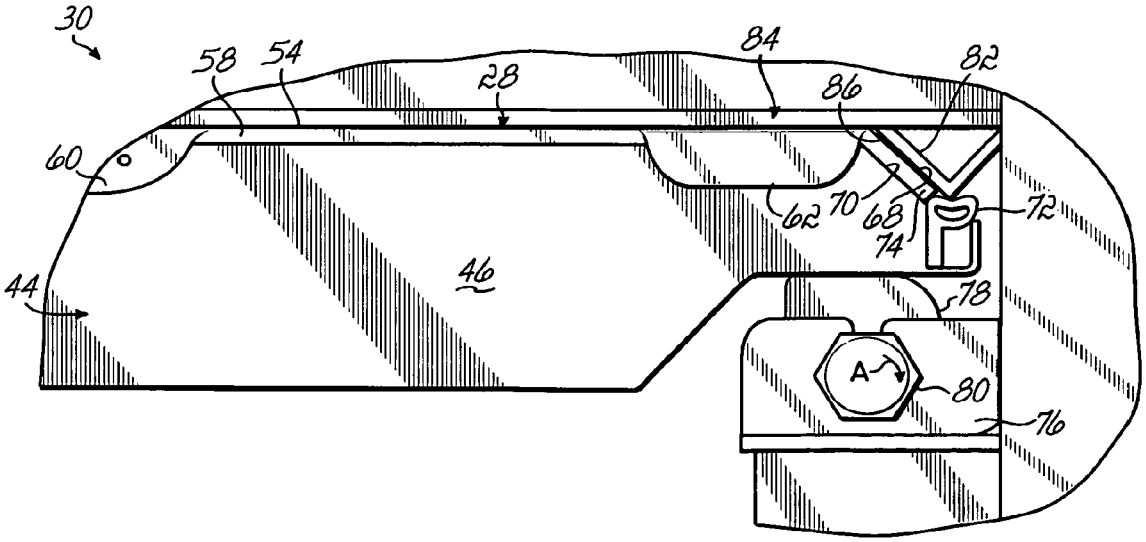
FIG. 5B is a view similar to FIG. 5A with the screen panel engaged with a screen panel carrier according to one aspect of this invention.

Referring to FIGS. 5A and 5B, the configuration of the screen panel frame 54 relative to the remainder of the screening machine 10 will now be described. The downwardly turned bevel edges 68 along the head and foot ends 64, 66 of the screen panel frames 54 are supported by a similarly inclined face 70 of the vibratory carrier 44 as shown in FIG. 5A. The carrier 44 also includes a compressible seal member 72 juxtaposed to the terminal edge 74 of the bevel edge 68 and mounted in the carrier 44. Likewise, the lower surface of the screen panel frame 54 is supported along a similarly configured profile of the carrier 44 as shown in FIG. 5A.

The screening machine 10 includes a bracket 76 in which a rotational cam 78 is seated to support the carrier 44. The rotation of the cam 78 is accomplished by an actuator 80 accessible to the operator or technician when the door 38 of the screening machine 10 is open. One known mechanism suitable for use with this invention to raise/lower the carrier 44 and screen panel 28 is disclosed in Rotex' U.S. Pat. No. 6,070,736 which is incorporated by reference herein. The screening machine 10 also includes a downwardly depending channel 82 initially spaced from the bevel lip 68 of the screen frame 54 as shown in FIG. 5A.

Upon rotation in the direction of arrow A of the actuator 80, the cam 78 is rotated thereby raising the carrier 44 and screen panel 28 supported thereon upwardly to sealing engagement with an upper portion 84 of the screen deck 30 as shown in FIG. 5B. As the carrier 44 supporting the screen panel 28 is raised, a face 86 of the channel 82 is juxtaposed against the bevel lip 68 of the screen panel 28 and the seal 72 is compressed against the channel 82. As a result, the portion of the screen deck 84 and upper surface of the screen panel frame 54 are sealed to prevent and inhibit the discharge of material being screened. Due to the design and configuration of the screen panel frame 54 and associated screen deck 30, the seal 72 and associated components are neither damaged nor compromised during the lateral installation and removal of the screen panel 28 thereby extending the service life of the associated components while maintaining effective sealing and associated screening operations. The orientation of the seal 72 is generally parallel with the lateral direction in which the screen panel is inserted and removed from the machine 10.

The bevel edges 68 on two opposite ends in conjunction with the lift system described in U.S. Pat. No. 6,070,736 permits insertion and proper location, alignment, sealing, and securing of the screen panel 28 to the screening machine 10 while maintaining a smooth transition (no bumps or wear points). This invention offers a screen panel 28 that is pre-tensioned, ready to use, lightweight, standardized in size to lower cost, simple design, mass producible, easy to handle, nestable for storage and shipping. The bevel lip 68 also acts as a seal holder for reusable seal strips 72.

Referring to FIGS. 1-3, the screen panel 28 of this invention includes a number of smaller cells 88 defined around the interior of the perimeter frame 54 by plurality of transverse and longitudinally extending ribs 90. Because the screen material 34 is flat and pressed, smaller cells 88 result in greater tension in the screen mesh material 34 since it has very little length and is held on both ends and it cannot deflect for a given load. The orientation of the ribs 90 may be skewed or not aligned with the orientation of the openings 52 defined by the threads 48, 50 of the screen material 34. Alternatively, the ribs 90 and threads 48, 50 of the screen material may be aligned with each other in the lateral and longitudinal direction. In one embodiment of the screen panel 28, the wire mesh screen material 34 is not bonded directly to the ribs 90, only the perimeter frame 54. Silicone may be used either as an adhesive to bond the screen material 34 to the frame 54 and/or as a buffer between the screen material 34 and another suitable adhesive known in the industry. It is believed that the silicone retards fatigue of the screen material 34 in use. As such, the service life of the screen panel 28 is extended and the economic benefit of this invention is maximized. It is expected that this general design provides improved throughput, service live and screening accuracy.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A method for installing a pre-tensioned screen in a gyratory sifter comprising:

inserting the pre-tensioned screen into the gyratory sifter, the pre-tensioned screen comprising:

a frame having a plurality of cross-members and a beveled edge extending downwardly and away from the frame; and a filtering element secureably attached to the frame;

mating the pre-tensioned screen to a ball box; wherein the mating comprises placing the beveled edge of the pre-tensioned screen against an inclined face of the ball box; and securing the pre-tensioned screen with a screen deck while maintaining a contacting relationship between the beveled edge of the pre-tensioned screen and the inclined face of the ball box.

2. The method of claim 1, wherein the securing comprises contacting a top portion of the pre-tensioned screen with a bottom portion of the screen deck.

3. The method of claim 1, wherein the securing comprises:

actuating a seal location device for moving the pre-tensioned screen into sealing engagement with the screen deck.

4. The method of claim 3, wherein the seal location device is a mechanical actuator, and further comprising engaging the ball box with the mechanical actuator.

5. The method of claim 1, wherein the frame further comprises a second beveled edge extending downwardly and away from the frame, the beveled edge and the second beveled edge extending along an entirety of at least two of the sides of the frame.

6. The method of claim 5, wherein the at least two sides of the frame include the longitudinal head end and longitudinal foot end of the frame.

7. The method of claim 1, wherein the inserting step further comprises:

inserting the pre-tensioned screen laterally into a side of the gyratory sifter in a direction generally perpendicular to the direction of travel of material in the gyratory sifter.

8. The method of claim 2, wherein the securing further comprises:

raising the pre-tensioned screen upwardly into contact with the screen deck, wherein the beveled edge is moved into engagement with a face of a downwardly depending channel of the screen deck.

9. The method of claim 1, wherein the filtering element is not attached directly to the plurality of cross-members.

10. The method of claim 1, wherein the frame includes a second beveled edge extending downwardly and away from the frame and the mating step further comprises:

placing the second beveled edge of the pre-tensioned screen against a second inclined face of the ball box.

11. The method of claim 1, wherein the beveled edge does not extend above a plane of the filter element on the frame.

12. The method of claim 1, wherein the pre-tensioned screen is not mated with a second pre-tensioned screen in the gyratory sifter.

13. The method of claim 1, further comprising:

positioning at least portions of the frame against a seal and moving the seal into contacting engagement with the screen deck to inhibit material being sifted from escaping off of the frame of the pre-tensioned screen.

14. A method for installing a pre-tensioned screen in a gyratory sifter comprising:

inserting the pre-tensioned screen into the gyratory sifter, the pre-tensioned screen comprising:

a frame having a plurality of cross-members and a beveled edge extending downwardly and away from the frame; and a filtering element secureably attached to the frame;

actuating a seal location device with a mechanical actuator;

mating the pre-tensioned screen to a ball box; wherein the mating comprises placing the beveled edge of the pre-tensioned screen against an inclined face of the ball box; and securing the pre-tensioned screen with a screen deck by contacting a top portion of the pre-tensioned screen with a bottom portion of the screen deck while maintaining a contacting relationship between the beveled edge of the pre-tensioned screen and the inclined face of the ball box.

15. The method of claim 14, wherein the frame further comprises a second beveled edge extending downwardly and away from the frame, the beveled edge and the second beveled edge extending along an entirety of at least two of the sides of the frame.

16. The method of claim 15, wherein the at least two sides of the frame include the longitudinal head end and longitudinal foot end of the frame.

17. The method of claim 14, wherein the inserting step further comprises:

inserting the pre-tensioned screen laterally into a side of the gyratory sifter in a direction generally perpendicular to the direction of travel of material in the gyratory sifter.

18. The method of claim 14, wherein the securing further comprises:

raising the pre-tensioned screen upwardly into contact with the screen deck, wherein the beveled edge is moved into engagement with a face of a downwardly depending channel of the screen deck.

19. The method of claim 14, wherein the frame includes a second beveled edge extending downwardly and away from the frame and the mating step further comprises:

placing the second beveled edge of the pre-tensioned screen against a second inclined face of the ball box.

20. The method of claim 14, wherein the beveled edge does not extend above a plane of the filter element on the frame.

21. A method for installing a pre-tensioned screen panel in a screening machine comprising:

inserting the pre-tensioned screen panel into the screening machine, the pre-tensioned screen panel comprising:

a frame having a rigid external beveled edge that extends from the periphery of the frame on at least two sides; and a filtering screen material secureably attached to the frame;

mating the pre-tensioned screen panel to a ball box; wherein the mating comprises placing the beveled edge of the pre-tensioned screen panel against an inclined face of the ball box; and securing the pre-tensioned screen with a screen deck while maintaining a contacting relationship between the beveled edge of the pre-tensioned screen and the inclined face of the ball box.

22. The method of claim 21 wherein the pre-tensioned screen panel further comprises a plurality of intersecting ribs forming cells within the frame.

23. The method of claim 1, wherein the beveled edge is oriented approximately 45° relative to an upper surface of the pre-tensioned screen.

* * * * *